US006250494B1

(12) United States Patent
Diamond

(10) Patent No.: US 6,250,494 B1
(45) Date of Patent: Jun. 26, 2001

(54) PLASTIC CONTAINERS WITH INTERLOCKING LIDS

(75) Inventor: David W. Diamond, Dudley, MA (US)

(73) Assignee: John Clementi, Princeton, MA (US)

( * ) Notice: Subject to any disclaimer, the term of this patent is extended or adjusted under 35 U.S.C. 154(b) by 0 days.

(21) Appl. No.: 09/281,367

(22) Filed: Mar. 30, 1999

(51) Int. Cl.[7] ..... B65D 41/16
(52) U.S. Cl. ..... 220/783; 220/789; 220/782
(58) Field of Search ..... 220/783, 782, 220/789, 801, FOR 100

(56) References Cited

U.S. PATENT DOCUMENTS

| | | | | |
|---|---|---|---|---|
| 3,566,946 | * | 3/1971 | Mac Donald | 220/783 |
| 4,124,141 | * | 11/1978 | Armentrout et al. | 220/783 |
| 4,180,179 | * | 12/1979 | Hoenig et al. | 220/783 |
| 4,225,045 | * | 9/1980 | Rayner et al. | 206/508 |
| 4,256,240 | * | 3/1981 | Woinarski | 220/782 |
| 4,293,080 | | 10/1981 | Letica . | |
| 4,334,631 | * | 6/1982 | Ballester | 220/783 |
| 4,349,119 | | 9/1982 | Letica . | |
| 4,356,930 | * | 11/1982 | Roper | 220/783 |
| 4,383,819 | | 5/1983 | Letica . | |
| 4,397,404 | * | 8/1983 | Blanchette | 220/783 |
| 4,420,093 | * | 12/1983 | Von Holdt | 206/508 |
| 4,446,986 | * | 5/1984 | Bowen et al. | 220/789 |
| 4,491,238 | * | 1/1985 | Toblot | 220/783 |
| 4,512,494 | * | 4/1985 | Von Holdt | 220/783 |
| 4,520,943 | * | 6/1985 | Nielsen | 220/783 X |
| 4,524,882 | * | 6/1985 | Buc | 220/783 |
| 4,577,776 | * | 3/1986 | Rayner et al. | 220/789 |
| 4,619,373 | | 10/1986 | Galer . | |
| 4,777,004 | | 10/1988 | Galer . | |
| 5,097,977 | | 3/1992 | Straub . | |
| 5,437,386 | * | 8/1995 | Von Holdt | 220/783 |
| 5,758,791 | * | 6/1998 | Mangla | 220/783 X |
| 5,833,116 | * | 11/1998 | Guillin | 220/783 |
| 6,006,942 | * | 12/1999 | Morris, Sr. et al. | 206/508 X |

FOREIGN PATENT DOCUMENTS

| | | | | |
|---|---|---|---|---|
| 2035277 | * | 6/1980 | (GB) | 206/508 |
| 2227481 | * | 8/1990 | (GB) | 220/783 |

* cited by examiner

*Primary Examiner*—Allan N. Shoap
*Assistant Examiner*—Robin A Hylton
(74) *Attorney, Agent, or Firm*—Pandiscio & Pandiscio

(57) ABSTRACT

A plastic container/removable lid combination for holding paint or other materials is provided. A bifurcated annular rim is molded at the top end of the container'side wall, the rim comprising outer and inner rim sections that are joined to one another at their bottom ends so as to define an annular locking channel, with the inner rim section extending inwardly of the side wall. The lid is formed with an annular rib having first and second mutually spaced leg sections that are movable toward one another under radial compression far enough to allow the rib to be inserted into the locking channel of the rim so as to releasably lock the lid to the container.

28 Claims, 3 Drawing Sheets

PLASTIC CONTAINERS WITH INTERLOCKING LIDS

The present invention relates generally to containers having removable lids that are capable of sealing off the contents of the containers, and more particularly to plastic containers for containing paint or other materials.

FIELD OF THE INVENTION

As is well known, the ordinary one-gallon paint can has been made of steel and is provided with a friction fit lid that also is made of steel. In the paint industry prevention of leakage is important since paint cans frequently encounter rough handling while being transported or stacked for storage or retail display. Consequently a substantially hermetic seal is required between the paint can and its lid. This is achieved by a friction fit air-tight engagement between the lid and container which is such as to permit the lid to be removed manually using a suitable prying tool. In addition, the standard metal paint can lid does not protrude beyond the perimeter of the paint can so that as to prevent accidental disengagement of the lid. The configuration of the interlocking connection between the standard metal paint cans and their metal lids is such that the lids remain tightly in place even when subjected to the action of paint shaking machines or to other severe handling or shock conditions. Further the lids can be re-attached to again provide a fluid tight seal with the container. However standard metal paint cans have certain shortcomings, one of which is the tendency to corrode.

In the past, efforts have been made to provide containers for paint that are made of plastic. For example, U.S. Pat. No. 5,097,977, issued Mar. 24, 1992 to R. Straub illustrates a closure assembly for a container that comprises a snap ring connected to the top of the container and a lid that is removably attached to the ring so as to close off the container. A similar arrangement is disclosed by U.S. Pat. No. 4,619, 373, issued Oct. 28, 1986 to H. W. Galer. Other plastic paint can designs and/or apparatus for injection molding same are illustrated by the following U.S. Patents: U.S. Pat. No. 4,777,004, issued Oct. 11, 1988 to H. W. Galer; U.S. Pat. No. 4,619,373, issued Oct. 28, 1986 to H. W. Galer; U.S. Pat. No. 4,349,119 issued Sep. 14, 1982 to I. Letica; U.S. Pat. No. 4,512, 494, issued Apr. 23,1985 to J. W. Von Holdt; U.S. Pat. No. 4,383,519 issued May 17,1983 to I. Letica; U.S. Pat. No. 4,293,080, issued Oct. 6, 1981 to I. Letica; and U.S. Pat. No. 3,977,563 issued Aug. 31, 1976 to W. G. Holt.

However, despite such prior efforts, heretofore no plastic paint can/lid design has been developed which has proven capable of displacing the standard steel can and lid from the marketplace. Prior plastic paint can/lid designs have suffered from various limitations, such as need for complex and costly injection molds, not capable of being handled by standard filling, labeling and packaging machinery, inadequate strength, unreliable sealing of lid to container, and/or lack of appeal to prospective customers.

SUMMARY OF THE INVENTION

The primary object or purpose of the invention is to provide a new and improved plastic can/lid design which is characterized by an improved rim-to-lid interlock which provides a positive, reliable fluid-tight seal even when subjected to rough handling.

A further object is to provide an improved plastic container capable of superior retention of its lid through a novel locking engagement between the lid and container.

Another object is to provide a plastic container/lid interlock that provides positive line contact sealing of lid to container.

A further object is to provide a combination container and lid that is characterized by a container/lid interlock which provides an air-tight friction fit, permits the lid to be easily removed by use of a prying tool, and assures that the lid cannot be accidentally dislodged as a consequence of being subjected to impact, shock or stress in the course of being stacked or transported.

Yet another object is to provide a plastic container for paint or other liquid or particulate material having a plastic lid that can be readily resealed.

Still another object is to provide a container/lid design wherein the container and lid have cooperating means to facilitate removal of the lid by means of a suitable prying tool.

A more specific object is to provide a plastic container for paint or other liquid product that has sufficient strength to allow it to be filled, capped, labeled, and stacked or packaged using conventional filling, labeling and packaging machinery.

Another specific object is to provide a plastic container for paint or other material that has a one-piece construction free of any seams or crimps, does not rust internally and requires no internal protective coating, has a higher dynamic compression that metal paint cans, can be manufactured in different colors and surface finishes, weighs less than a metal can of comparable size and volume, can be molded with embossed printing so as to eliminate the need for a subsequent labeling operation, and, for example, may be molded on the premises of a paint manufacturer.

Still other objects and features of the invention are disclosed or rendered obvious by the following detailed description which is to be considered together with the accompanying drawings.

SPECIFIC DESCRIPTION OF PREFERRED EMBODIMENT

Figure 1:
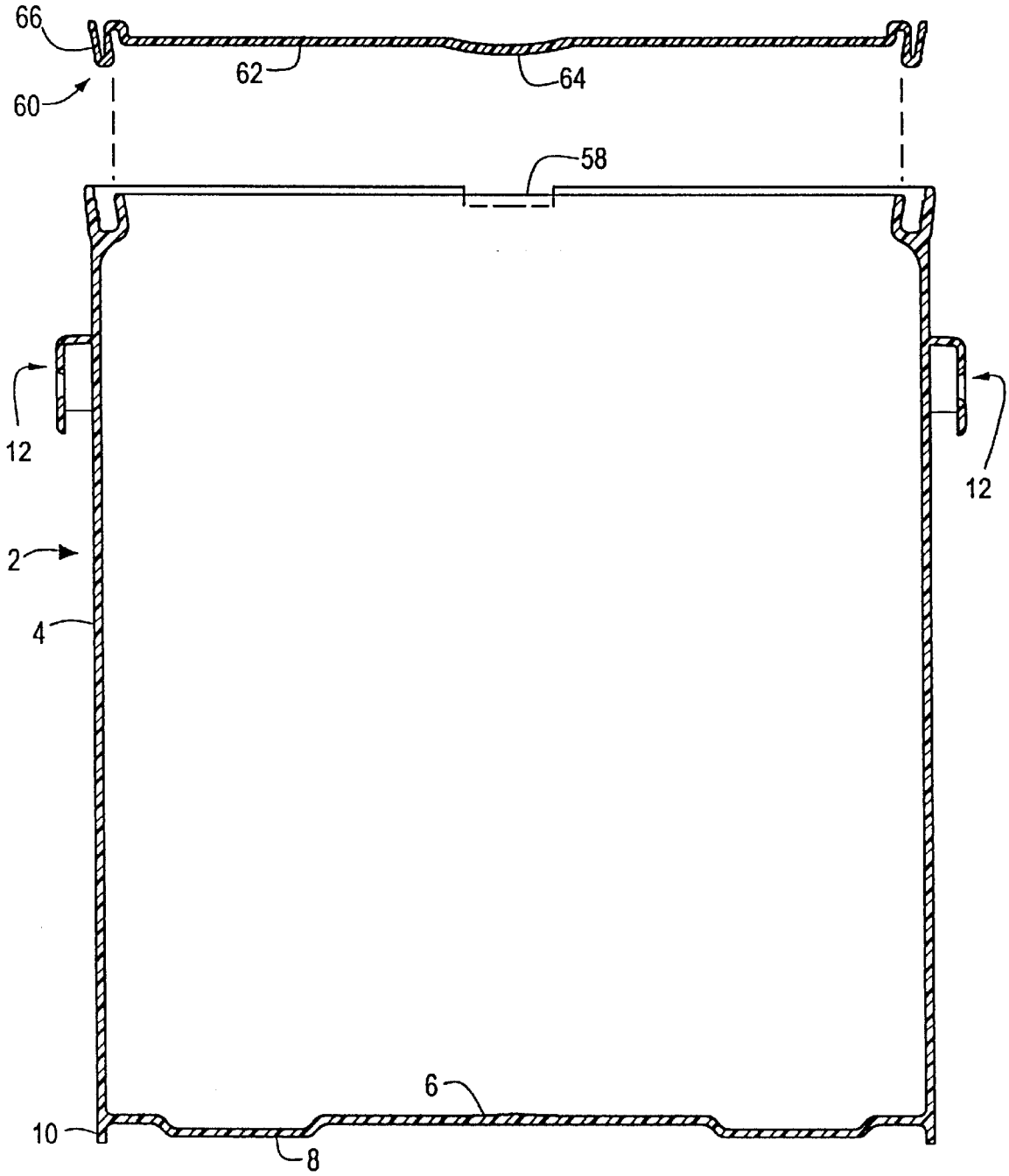
FIG. 1 is an exploded sectional view in elevation showing a container and a lid therefor that embody the present invention.
Figure 2:
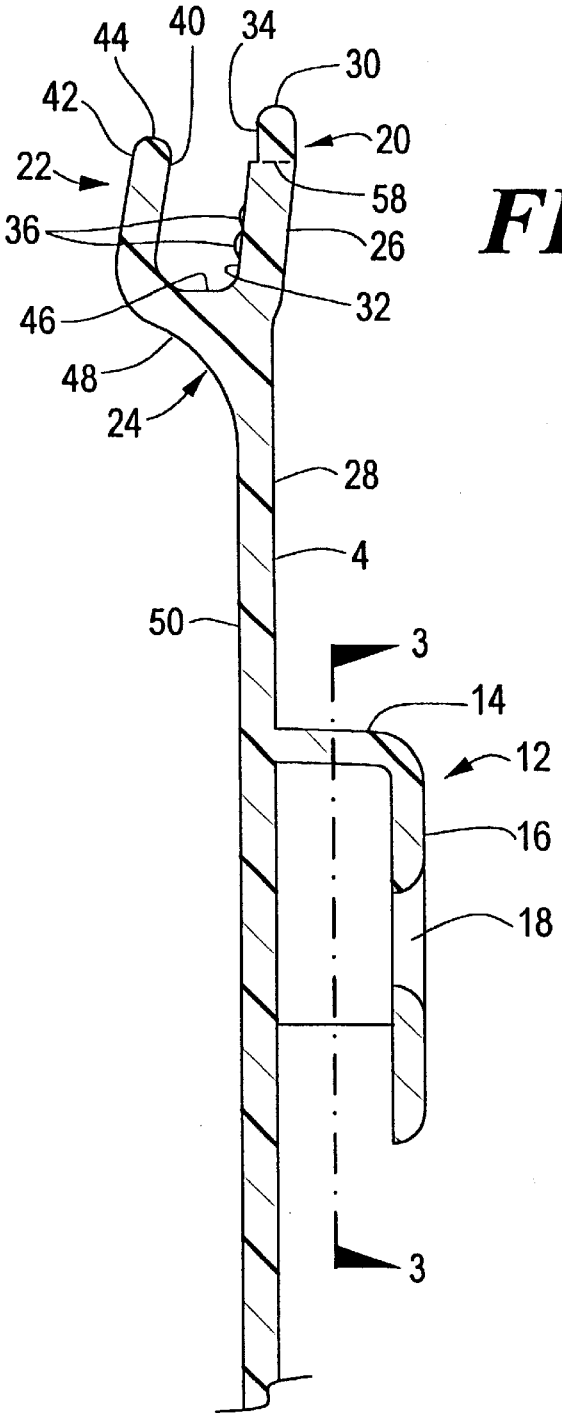
FIG. 2 is an enlarged scale fragmentary sectional view in elevation showing details of the rim on the upper end of the same container.
Figure 3:
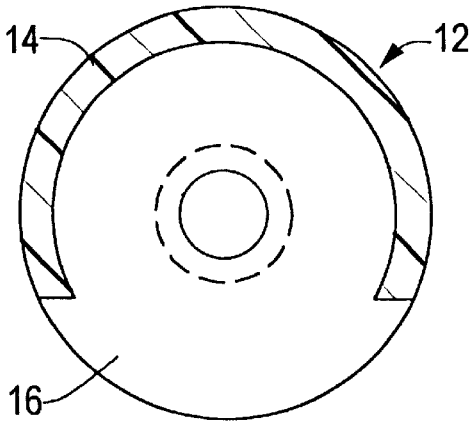
FIG. 3 is a sectional view taken along line 3—3 of FIG. 2.

Referring now to FIG. 1, there is shown an injection-molded container 2 that is made of a suitable plastic material that combines resiliency and strength, e.g., high density polyethylene. Container 2 comprises a side wall 4, and a bottom wall 6 which preferably is contoured as shown to provide a flat annular downwardly projecting rib 8 for strengthening purposes. Side wall 4 essentially is a constant diameter cylinder. The bottom end of the paint can also has an axially extending seating flange 10 that forms a continuation of side wall 4. Flange 10 may be flush with rib 8 but preferably it projects below the plane of that rib. The side wall also has two diametrically opposed perforated ears 12. As seen in FIGS. 2 and 3, ears 12 comprise a curved side wall 14 that extends through an angle of at least 180° degrees, preferably about 200°, and a front wall 16 that has a tapered hole 18 for acceptance of one end of a wire handle (not shown) of the kind commonly used on metal paint cans. Hole 18 serves as a pivot point for the wire handle.

Referring now to FIG. 2, the upper end of the side wall 4 is formed with a split or bifurcated rim, the rim comprising an outer rim section 20, an inner rim section 22, and a rim-connecting section 24. The outer rim section 20 is essentially an extension of side wall 4 and has an outer surface 26 that preferably, but not necessarily, projects radially slightly beyond the outer surface 28 of side wall 4. Surface 26 may be a straight cylinder or, as shown, may extend at a slight angle to outer surface 28. Preferably, but not necessarily, the upper end edge of outer rim section 20 is rounded off as shown at 30. The inner surface of outer rim section 20 is identified generally by numeral 32. Inner surface 32 extends at a selected acute angle, e.g., an angle between 6 and 70°, to sidewall 4 and the longitudinal center axis of the container. Preferably, but not necessarily, the diameter of the upper end of inner surface 32 is enlarged so as to provide an offset or recessed cylindrical surface portion 34 that extends substantially parallel to the longitudinal (vertical) axis of container 2. The inner surface 32 also is formed with two locking or gripping ribs 36 that are convex in cross-section and preferably extend around the full circumference of the container rim. Alternatively, the ribs 36 could be interrupted at selected points about the circumference of outer rim section 20.

The inner rim section 22 is located inwardly of side wall 4. Rim section 22 has substantially parallel outer and inner surfaces 40 and 42, with at least surface 40, but preferably also surface 42, extending at a selected acute angle, e.g., an angle between about 9° and 10°, to the side wall 4. Preferably, but not necessarily, surface 40 of rim section 22 is smooth. However, it could also be provided with gripping ribs similar to ribs 36. Preferably, but not necessarily, the upper end edge of rim section 22 is rounded as shown at 44.

Preferably but not necessarily, the rim-connecting section 24 is formed with a generally concave upper surface 46. The bottom surface 48 of section 24 preferably forms a gentle curved transition between the inner surface 42 of inner rim section 22 and the inner surface 50 of side wall 4.

Surfaces 32, 40 and 46 together define an annular locking channel for a lid 60 hereinafter described. In this connection, it should be noted that the surface 40 of inner rim section 22 is not parallel to the inner surface 32 of outer rim section 20; instead those surfaces are in a converging relation with one another away from rim-connecting section 24. Preferably they converge on one another at an angle of between about 2° and 4° with increasing distance from bottom wall 6. In other words, the spacing between surfaces 32 and 40 is greatest near surface 46 and smallest near the top end of rim section 22.

The outer rim section 20 is provided with one or more notches 58 at its upper edge (FIGS. 1 and 2) to facilitate removal of a plastic lid or cover 60. Lid 60 preferably is made of the same material as container 2. The lid is circular and comprises a generally flat center or crown section 62 that preferably, but not necessarily, is dimpled at its center as shown at 64, and a convoluted rim section identified generally by the numeral 66 that is adapted to mate with the bifurcated rim section of container 2.

Figure 4:
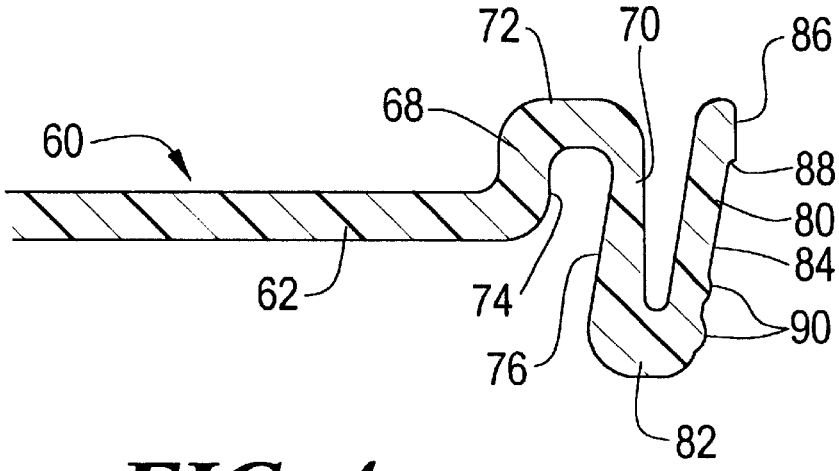
FIG. 4 is an enlarged fragmentary sectional view in elevation of the lid.

As seen best in FIG. 4, the convoluted rim section 66 of the lid or cover is characterized by a first upstanding circumferentially-extending rib that comprises an inner wall or leg section 68 that is joined to an outer wall or leg section 70 by a curved connecting wall section 72. The inner section 68 has an outer peripheral surface 74 that is substantially cylindrical and parallel to the center axis of the lid, while the outer section 70 has an inner circumferentially-extending surface 76 that is canted with the respect to the wall surface 74. Surface 76 is slanted extending downwardly and inwardly at an angle to the center axis of the lid that is approximately the same as the angle of the surfaces 32 and 40 relative to the center axis of the containers. Preferably, surface 76 extends at an angle of about 7° to 10° to the center axis of the lid.

The wall section 70 also forms part of a second downwardly projecting rib that also comprises an outer wall section 80 and a curved connecting wall section 82. Outer wall section 80 also has an outer surface 84 that extends at an angle that preferably is substantially the same as the angle of the surface 76. Alternatively, wall section 80 may be formed so that the angle of outer surface 84 relative to the lid's center axis is slightly greater than the angle of surface 76, e.g., 1°–3° greater. The upper end of wall section 80 has an outer peripheral surface portion 86 that is essentially cylindrical and is parallel to the center axis of the lid. Surface portion 86 projects outwardly beyond surface 84, so as to form a shallow shoulder or ledge 88. Additionally the outer surface 84 is provided with a pair of locking or gripping ribs 90 that preferably are convex in cross-section as seen in FIG. 4. Ribs 90 are designed to mate and interlock with the similarly shaped ribs 36 formed on the container rim. Ribs 90 preferably extend around the full circumference of surface 84, but alternatively they could be interrupted at selected points about the circumference of surface 84.

Making the container and lid of a resilient strong material such as a high density polyethylene is advantageous, particularly in the case of making one gallon paint cans, in that the material provides the container with sufficient strength to resist deformation under the weight of one or more like-filled containers. At the same time, the plastic material can flex sufficiently to allow the lid to be secured in place on the container so as to seal off the container's contents.

Figure 5:
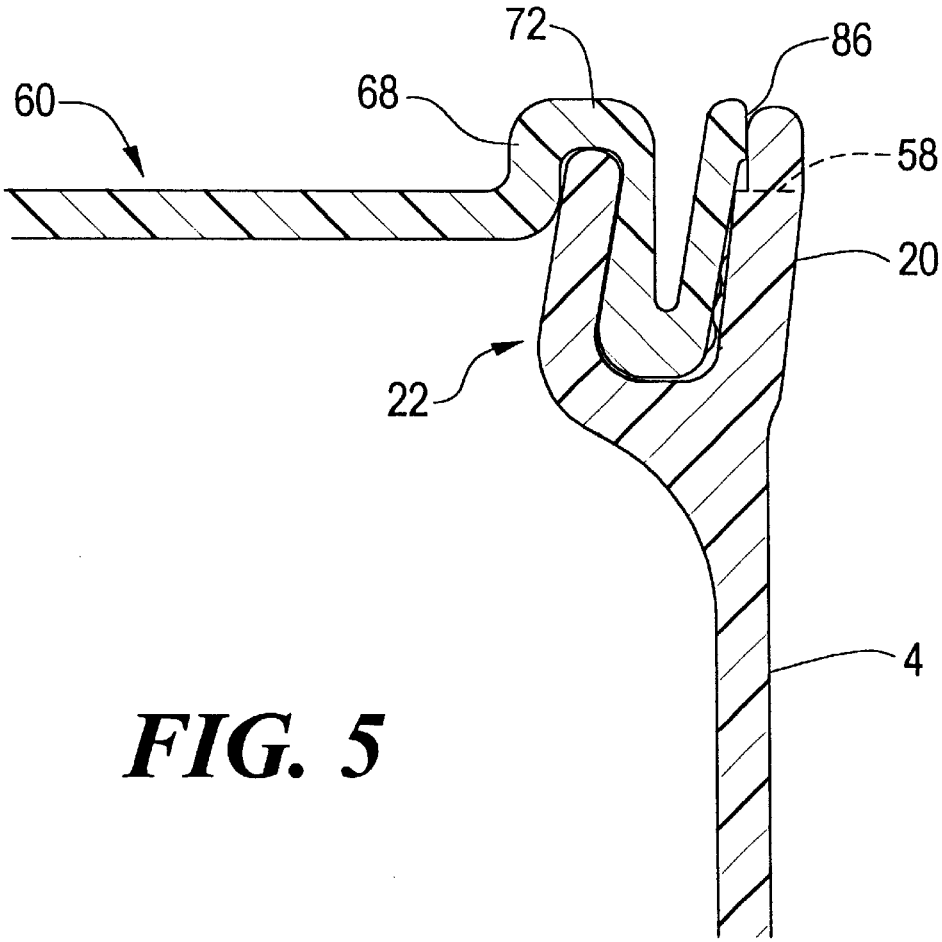
FIG. 5 is a fragmentary sectional view on an enlarged scale showing how the lid interlocks with the rim of the container.

In this connection it should be understood that the downwardly projecting rib on the lid formed by wall sections 70, 80 and 82 is designed to make a friction fit in the channel formed between the outer and inner rim sections 20 and 22 of the container. The distance between the surfaces 76 and 84 of the downwardly projecting rib of the rim may be equal to but preferably is slightly in excess of the distance between the surfaces 32 and 40 of container rim sections 20 and 22 respectively. However, that rib is sufficiently resilient as to allow sections 70 and 80 to be forced toward one another under a radial compressing force. Consequently, as shown in FIG. 5, when the lid is attached to the rim section of the container, the depending rib comprising wall sections 70, 80 and 82 makes a tight friction fit in the channel between rim sections 20 and 22, with the gripping ribs 90 interlocking with gripping ribs 36.

When the lid is attached to the container, its periphery is surrounded and protected by the upper end of rim section 20. The maximum outside diameter of the combined container and lid is essentially the outside diameter of the outer rim section 20 measured at the upper edge of its outer surface 26. Since that diametrical dimension is nearly the same as that of the outer diameter of wall 4, the plastic cans provided by the invention have an appearance substantially the same of those of a conventional metal paint can. Additionally, the interconnection of the lid with the container is such that a fluid-tight seal is formed between the lid and the container, thereby preventing leakage of contents and assuring that the contents will not undergo degradation due to oxidation. Removal of the lid from the can is facilitated by the presence of notches 58 in the upper end of rim section 20. Notches 58 permit a screwdriver or other tool to be engaged with shoulder 88 to pry the lid off of the container.

Although the preferred embodiment of the invention is a one gallon paint can and the lid for same, it is to be understood that containers embodying the present invention may be used to hold a wide variety of different materials and that the container and lid sizes may be varied according to user requirements.

One gallon high density polyethylene paint cans and lids embodying the invention have been molded with the following dimensional characteristics: a side wall outside diameter of about 6.550 inches, a side wall and bottom wall thickness of about 0.067", an outer surface 26 of outer rim section 20 having a maximum diameter that exceeds the outside diameter of the side wall by not more than about 0.090", an inner rim section 22 having an inner surface 42 with a diameter that varies between about 0.380 and about 0.448 inches less than the inside diameter of side wall 4, and a minimum distance between surfaces 32 and 40 of about 0.147 inch. Additionally, surface 32 extends at angles of about 7° to the longitudinal center axis of the interior and surface 40 extends at an angle of about 9° to the same axis, so that surfaces 32 and 40 converge on one another with increasing distance away from rim-connecting section 24. A lid for interconnection with such a container may have a maximum outside diameter of about 6.507 inches, with the distance between surfaces 76 and 84 (exclusive of ribs 90) being about the same as or preferably about 0.005" greater than the minimum distance between surface 32 and 40 (exclusive of ribs 36). The ribs 36 and 90 project about 0.012" from surfaces 32 and 84 respectively, and the average thickness of the lid is about 0.060 inch. Such a lid will make a tight seal with the container, and a plurality of such containers after filling and sealing may be stacked safely one upon the other like metal paint cans. With respect to the lid it should be noted that the sections 68 and 72 and the upper portion of wall section 70 form an upwardly projecting lid-reinforcing rib.

Containers and lids embodying the present invention may be made in sizes larger or smaller than the conventional one-gallon size commonly used by American paint manufacturers. Although in the preferred embodiment of the invention the side wall of the container is cylindrical, i.e., it has a constant diameter, it is also contemplated that the side wall may be tapered by a selected draft angle, e.g., 1°–3°, so that the upper end of the container has a larger diameter than its bottom end. Also the container need not have the strengthening rib 8, or any equivalent strengthening feature, recognizing that the need or desire for such feature may be determined or result from a number of factors or functions, e.g., container size, overall weight of the contents of the container, and the material of which the container is made. The number of gripping ribs 36 and 90 also may be varied. Also, alternatively or additionally, gripping ribs like ribs 36 and 90 may be formed on container rim 40 and lid surface 76. If desired, the locking ribs 36 and 90 may be omitted, so that the lid is locked to the container rim solely as a result of the rib sections 70 and 80 being compressed together between and gripped by surfaces 32 and 40. Although it is preferred to make the containers and lids of a high density polyethylene, they also may be molded of other plastics materials known to persons skilled in the art, e.g., polypropylene.

Still other changes will be obvious to persons skilled in the art from the foregoing description and FIGS. 1–5.

The invention offers the advantage of providing a plastic container for use in holding paint or other products in liquid or particulate form that has sufficient strength to allow it to be filled, capped, labeled, and stacked or packaged using conventional filling, labeling and packaging machinery. Still other advantages provided by this invention are that the containers have a one-piece construction free of any seams or crimps, do not rust internally and require no internal protective coating, have a higher dynamic compression that metal paint cans, can be manufactured in different colors and surface finishes, weigh less than metal cans of comparable size and volume, can be molded with embossed printing so as to eliminate the need for a subsequent labeling operation. A further significant advantage is that containers and lids embodying the invention may be molded at the site of filling, e.g., molded on the premises of a paint manufacturer. This offers the further benefit of allowing the party who fills the containers to manufacture them and their lids according to the party's production requirements, thereby avoiding the cost of carrying a large inventory of unfilled containers.

What is claimed is:

1. A plastic container adapted to be closed and sealed by a removable interlocking lid;

said container comprising a bottom wall, a side wall formed integral with and extending upwardly from said bottom wall, and an open top, said side wall having inner and outer surfaces, said side wall having a circular configuration in cross-section and having at its top end a bifurcated annular rim that comprises an outer rim section that is an extension of said side wall and an inner rim section that is joined at its bottom end to said outer rim section, said outer and inner rim sections being spaced from one another so as to define an annular locking channel therebetween, with substantially all of said channel being disposed inwardly of said inner surface of said side wall, said outer rim section having a first upper edge facing away from said bottom wall and an inner annular surface, and said inner rim section having a second upper end edge facing away from said bottom wall and an outer annular surface that confronts said inner annular surface, said inner and outer annular surfaces extending lengthwise relative to said side wall and being spaced from one another with the spacing being greatest adjacent where they are joined, said outer annular surface extending to and terminating at said second upper end edge of said inner rim section.

2. A plastic container according to claim 1 wherein said outer rim section extends further than said inner rim section from said bottom wall, and further wherein said inner annular surface of said outer rim section includes a recessed portion adjacent said first upper end edge.

3. A container according to claim 2 wherein said recessed portion extends for the full circumference of said inner annular surface.

4. A container according to claim 2 wherein said upper end edge of said outer rim section has at least one notch to accommodate a tool for use in prying a lid off of said container, said at least one notch extending through said recessed portion of said inner annular surface of said outer rim section.

5. A plastic container according to claim 1 further including one or more locking projections on at least one of said annular surfaces, said one or more locking projections being located between the upper and lower ends of said at least one annular surface.

6. A container according to claim 1 wherein at least one of said inner and outer annular surfaces is provided with means projecting into said annular channel for interlocking with a lid, said projecting means being located intermediate the upper and lower ends of said at least one annular surface.

7. A container according to claim 6 wherein said projecting means comprises at least one circumferentially-extending rib formed on said inner annular surface.

8. A container according to claim 1 wherein said upper end edge of said outer rim section has one or more notches to accommodate a tool for use in prying a lid off of said container.

9. A container according to claim 1 wherein said outer annular surface of said inner rim section extends at an acute angle to said side wall, with said inner rim section having a maximum diameter at its said upper end edge.

10. A container according to claim 1 wherein said inner annular surface of said outer rim section extends to and terminates at said first upper end edge of said outer rim section.

11. A plastic container in combination with a removable interlocking lid, said container comprising a bottom wall, a side wall formed integral with and extending upwardly from said bottom wall, and an open top, said side wall having a circular configuration in cross-section and having at its top end a bifurcated annular rim that comprises an outer rim section and an inner rim section that are joined to one another at their bottom ends and define an annular locking channel, said outer rim section having an upper end edge facing away from said bottom wall and an inner annular surface that extends to and terminates at said upper end edge, said inner rim section being disposed inwardly of said side wall and having an upper end edge facing away from said bottom wall and an outer annular surface that is joined to its said upper end edge and confronts said inner annular surface, said inner and outer annular surfaces being spaced from one another with the spacing being greatest adjacent where they are joined;

said lid being made of a resilient plastic and having at its periphery an annular locking rib, said locking rib comprising an outer annular leg section, an inner annular leg section, and a bottom section connecting said outer and inner leg sections, said outer leg section having an outer annular surface and said inner leg section having an inner annular surface, said outer and inner leg sections being formed so that when said lid is separated from said container the spacing between their said outer and inner annular surfaces respectively adjacent said bottom section is slightly greater than the width of said locking channel at the upper ends of said outer and inner rim sections, said locking rib extending into said channel with its said outer and inner annular surfaces being engaged with the inner annular surface of said outer rim section and the outer annular surface of said inner rim section respectively and said leg sections of said locking rib being gripped and radially compressed toward one another by said outer and inner rim sections.

12. A plastic container in combination with a removable interlocking lid, said container comprising a bottom wall, a side wall formed integral with and extending upwardly from said bottom wall, and an open top, said side wall having a circular configuration in cross-section and having at its top end a bifurcated annular rim that comprises an outer rim section and an inner rim section that are joined to one another at their bottom ends and define an annular locking channel, said outer rim section having an inner annular surface and said inner rim section being disposed inwardly of said side wall and having an outer annular surface that confronts said inner annular surface, said inner and outer annular surfaces being spaced from one another with the spacing being greatest adjacent where they are joined;

said lid being made of a resilient plastic and having at its periphery an annular locking rib that extends into said locking channel, said locking rib comprising an outer annular leg section, an inner annular leg section, and a bottom section connecting said outer and inner leg sections, said outer leg section having an outer annular surface and said inner leg section having an inner annular surface, said outer and inner leg sections being formed so that the spacing between their said outer and inner annular surfaces respectively adjacent said bottom section is slightly greater than the width of said locking channel at the upper end of said rim section, whereby said outer and inner leg sections of said locking rib are gripped and radially compressed toward one another by said outer and inner rim sections; and at least one locking projection on said inner annular surface of said outer rim section of said container, and at least one locking projection on said outer annular surface of said outer leg section of said locking rib, said at least one locking projection on said inner annular surface of said outer rim section being engaged with said at least one locking projection on said outer annular surface of said outer leg section so as to releasably lock said lid to said container.

13. A plastic container in combination with a removable interlocking lid;

said container comprising a tubular side wall having a top end and a bottom end and a circular cross-sectional configuration, a bottom wall formed integral with said bottom end of said side wall and closing off the bottom of said container, and an annular rim that is formed integral, with the top end of said side wall and comprises first and second concentric rim sections with said first rim section surrounding and spaced from said second rim section, said first and second rim sections having mutually confronting annular surfaces that extend lengthwise relative to said side wall and define an annular groove that has a closed bottom end and an open top end and is narrower at said open top end than at said closed bottom end, each of said mutually confronting annular surfaces extending from said top end to said bottom end of said annular groove, said mutually confronting annular surfaces being inclined in the same direction relative to the central axis of said container so that the distance between said annular surfaces and said central axis is greater at said top end of said annular groove than at said bottom end of said annular groove, said second rim section having inner and outer diameters that are less than the inside diameter of the top end of said side wall with at least a substantial part of said annular groove being disposed inwardly of the top end of said side wall; and said lid comprising a center body section, and an annular locking rib surrounding said center body section, said locking rib comprising first and second annular leg sections each having a top end and a bottom end, and an end section connecting said bottom ends of said first and second leg sections, said first leg section surrounding and spaced from said second leg section, said first leg section having an outer annular surface and said second leg section having an inner annular surface, said locking rib projecting into said annular groove with said outer annular surface of said first leg section and said inner annular surface of said second leg section extending along side of and being gripped by said mutually confronting surfaces of said first and second rim sections respectively.

14. A combination according to claim 13 wherein said mutually confronting surface of said first rim section extends at an angle of between 6 and 7 degrees to said central axis and said mutually confronting surface of said second rim section extends at an angle of between about 9 and 10 degrees to said central axis.

15. A combination according to claim 13 wherein one of said rim sections and one of said leg sections of said locking rib have radially-extending projections that are mutually engaged so as to lock said lid to said container.

16. A plastic container in combination with a removable interlocking lid;

said container comprising a tubular side wall having a top end and a bottom end and a circular cross-sectional configuration, and a bottom wall formed integral with said bottom end of said side wall and closing off the bottom of said container, said top end of said side wall having an annular rim that is formed integral with said side wall and comprises first and second concentric rim sections with said first rim section surrounding and spaced from said second rim section, whereby an annular groove is formed between said first and second rim sections with said groove having a closed bottom end and an open top end and being narrower at said open top end than at said closed bottom end, said second rim section having inner and outer diameters less than the inside diameter of said side wall whereby substantially all of said annular groove is disposed inwardly of said side wall; and said lid comprising a center body section, and an annular locking rib surrounding said center body section, said locking rib comprising first and second annular leg sections each having a top end and a bottom end, and an end section connecting said bottom ends of said first and second leg sections, said first leg section surrounding and spaced from said second leg section, said locking rib being sized to fit into said annular groove with said first and second leg sections being engaged with and gripped by said first and second rim sections respectively, said lid also having a top side and a bottom side, and a reinforcing rib formed adjacent its periphery, said reinforcing rib projecting upwardly from said top side of said lid and comprising mutually spaced inner and outer annular portions with said outer annular portion being formed integral with and as an extension of said second leg section of said locking rib, and further wherein said inner rim section extends between said inner and outer annular portions of said reinforcing rib.

17. An injection molded thermoplastic container having an open top end and a closed bottom end and a side wall having a circular configuration in cross-section, said side wall terminating at said open top end with an annular rim that is formed integral with said side wall and comprises an outer rim section that is a direct extension of said side wall, an inner rim section that is spaced from and is surrounded by said outer rim section, and a transverse rim section that connects said inner rim section to said outer rim section at the junction of said outer rim section with said side wall, said outer and inner rim sections having mutually confronting surfaces that cooperate with said transverse rim section to define an annular locking channel that is disposed inwardly of said side wall; and a lid attached to and closing off said top end of said container, said lid having a central body section having a top side surface and a bottom side surface, and a lid-locking section surrounding said central body section, said lid locking section comprising a first annular rib projecting upwardly beyond the level of said top side surface and a second annular rib formed integral with said first rib and projecting downwardly beyond the level of said bottom side surface, said second rib comprising first and second mutually spaced leg sections and a bottom section connecting said first and second leg sections, said second leg section surrounding said first leg section, said first leg section having an inner annular surface and said second leg section having an outer annular surface that are spaced from one another by a distance slightly greater than the width of said annular locking channel, said first and second leg sections being movable toward one another under radial compression far enough to allow said second annular rib to be inserted into said locking channel so as to cause said inner and outer annular surfaces to be gripped by said inner and outer rim sections, whereby to releasably lock said lid to said container.

18. The combination of claim 17 wherein said mutually confronting surfaces of said rim sections extend at acute angles in the same direction relative to said center axis of said container.

19. The combination of claim 17 wherein said inner and outer rims sections have upper end edges and said annular surfaces extend to said upper end edges.

20. A plastic container in combination with a removable interlocking lid;

said container comprising a tubular side wall having a top end and a bottom end, a bottom wall formed integral with said bottom end of said side wall and closing off the bottom of said container, and an annular flange at the periphery of said bottom wall, said annular flange projecting substantially parallel to the central longitudinal axis of said container away from said top end of said side wall, said top end of said side wall comprising first and second concentric rim sections, with first rim section having a first upper end edge and an inner annular surface that extends to and terminates at said first upper end edge, said second rim section having a second upper end edge and an outer annular surface that extends to and terminates at said second upper end edge, said inner annular surface of said first rim section surrounding and spaced from said outer annular surface of said second rim section, and said second rim section having an inner diameter less than the inside diameter of said side wall adjacent to said rim sections, said inner and outer annular surfaces coacting to define, an annular groove between said first and second rim sections, said groove having a closed bottom end and an open top end and being narrower at said open top end than at said closed bottom end and substantially all of said groove being disposed inwardly of said side wall; and said lid comprising a center body section, and an annular locking rib surrounding said center body section, said locking rib comprising first and second annular leg sections each having a top end and a bottom end, and an end section connecting said bottom ends of said first and second leg sections, said first leg section surrounding and spaced from said second leg section, said first leg section having and outer annular surface and said second leg section having an inner annular surface, and said locking rib extending into said annular groove with said annular surfaces of said first and second leg sections being engaged with and gripped by said annular surfaces of said first and second rim sections.

21. A plastic container in combination with a removable interlocking lid;

said container comprising a tubular side wall having a top end and a bottom end, and a bottom wall formed integral with said bottom end of said side wall and closing off the bottom of said container, said top end of said side wall comprising first and second concentric rim sections with said first rim section surrounding and spaced from said second rim section, and said second rim section having an inner diameter less than the inside diameter of said side wall immediately below said rim sections, said first rim section having a first upper end edge and an inner annular surface that extends to said first upper end edge, said second rim section having a second upper end edge and an outer annular surface that extends to said second upper end edge, said inner and outer annular surfaces coacting to define an annular groove between said first and second rim sections with said groove having a closed bottom end and an open top end and being narrower at said open top end than at said closed bottom end; and said lid comprising a center body section, and an annular locking rib surrounding said center body section, said locking rib comprising first and second annular leg sections each having a top end and a bottom end, and an end section connecting said bottom ends of said first and second leg sections, said first leg section surrounding and spaced from said second leg section and both of said leg sections being inclined to the central axis of said lid, said locking rib being sized to fit into said annular groove with said first and second leg sections being engaged with and gripped by said annular surfaces of said first and second rim sections respectively.

22. The combination of claim 21 wherein said leg sections are inclined so that their top ends extend further than their bottom ends from the central axis of said lid.

23. A combination according to claim 21 wherein said leg sections and said rim sections are inclined in the same direction relative to the central axis of said container.

24. An injection molded thermoplastic container having an open top end and a closed bottom end and a side wall having a circular configuration in cross-section, said side wall terminating at said open top end with an annular rim that comprises an outer rim section that is an extension of said side wall, an inner rim section that is spaced from and is surrounded by said outer rim section, and a transverse rim section that connects said inner rim section to said outer rim section at the junction of said outer rim section with said side wall, said outer and inner rim sections and said transverse rim section defining an annular locking channel; and a lid attached to and closing off said top end of said container, said lid having a central body section having a top side surface and a bottom side surface, and a lid-locking section surrounding said central body section, said lid locking section comprising a first annular rib projecting upwardly beyond the level of said top side surface and a second annular rib formed integral with said first rib and projecting downwardly beyond the level of said bottom side surface, said second rib comprising first and second mutually spaced leg sections and a bottom section connecting said first and second leg sections, said second leg section surrounding said first leg section, said first leg section having an inner annular surface and said second leg section having an outer annular surface that are spaced from one another by a distance slightly greater than the width of said annular locking channel, said first and second leg sections being movable toward one another under radial compression far enough to allow said second annular rib to be inserted into said locking channel so as to cause said inner and outer annular surfaces to be gripped by said inner and outer rim sections, whereby to releasably lock said lid to said container;

said inner and outer rim sections having mutually confronting surfaces that grip said annular surfaces of said second rib of said lid, said mutually confronting surfaces of said rim sections and said annular surfaces of said leg sections being inclined to the center axis of said container so that their distance from the center axis of said container increases with increasing distance from the bottom end of said side wall.

25. The combination of claim 24 wherein said inner and outer annular surfaces are inclined at substantially the same angle as said mutually confronting surfaces of said rim sections.

26. A plastic container in combination with a removable interlocking lid;

said container comprising a tubular side wall having a top end and a bottom end and a circular cross-sectional configuration, and a bottom wall formed integral with said bottom end of said side wall and closing off the bottom of said container, said top end of said side wall comprising first and second concentric rim sections each having upper end edges, with said first rim section surrounding and spaced from said second rim section and said second rim section having inner and outer diameters less than the inside diameter of said side wall, whereby an annular groove is formed between said first and second rim sections with said groove having a closed bottom end and an open top end and being narrower at said open top end than at said closed bottom end and substantially all of said annular groove being disposed inwardly of said side wall, said first rim section having an annular inner surface that forms one side of said groove and a circumferentially-extending recess in said annular inner surface that extends to its said top end edge, said first rim section also having at least one notch in its said top end edge that extends to said recess, said at least one notch having a height of predetermined magnitude measured lengthwise of said container; and said lid comprising a center body portion, and an annular locking rib surrounding said center body section, said locking rib comprising first and second annular leg sections each having a top end and a bottom end, and an end section connecting said bottom ends of said first and second leg sections, said first leg section surrounding and spaced from said second leg section, said locking rib being sized to fit into said annular groove with said first and second leg sections being engaged with and gripped by said first and second rim sections respectively, said first leg section having a free end, said first leg section also having a substantially cylindrical peripheral surface portion at said free end that projects therefrom outwardly away from said second leg section and a radially-extending shoulder adjacent said peripheral surface portion, said cylindrical surface portion having a diameter that is sized so that it will fit in said recess and an axial length that is less than the depth of said at least one notch, whereby a tool may be inserted into said at least one notch into engagement with said shoulder for the purpose of prying said lid off of said container.

27. A plastic container adapted to be closed and sealed by a removable interlocking lid;

said container comprising a bottom wall, a side wall formed integral with and extending upwardly from said bottom wall, and an open top, said side wall having inner and outer surfaces, said side wall also having a circular configuration in cross-section and having at its top end a bifurcated annular rim that is formed integral with said side wall and comprises an outer rim section and an inner rim section that are joined to one another at their bottom ends and define an annular locking channel that is disposed inwardly of said inner surface of said side wall and has an open top end and a closed bottom end, said outer rim section being an extension of said side wall and extending further than said inner rim section from said bottom wall, said outer rim section having an upper end edge and an inner annular surface and said inner rim section having an upper end edge and an outer annular surface that confronts said inner annular surface, said inner and outer annular surfaces extending lengthwise relative to said side wall from said bottom end to said top end of said locking channel and extending in the same direction relative to said side wall, said outer annular surface being substantially flat and said inner annular surface including a recessed portion adjacent said upper end edge thereof, at least one circumferentially extending projection on at least one of said annular surfaces for interlocking with a removable lid, said at least one projection being located intermediate the upper end edge and the bottom end of said one rim section, and at least one notch in said upper end edge of said outer rim section extending to said recessed portion of said inner annular surface for accommodating a tool for use in proving a lid off of said container.

28. A plastic container adapted to be closed and sealed by a removable interlocking lid;

said container comprising a bottom wall, a side wall formed integral with and extending upwardly from said bottom wall, and an open top, said side wall having inner and outer surfaces, said side wall also having a circular configuration in cross-section and having at its top end a bifurcated annular rim that is formed integral with said side wall and comprises an outer rim section and an inner rim section that are joined to one another at their bottom ends and define an annular locking channel that is disposed inwardly of said inner surface of said side wall and has a closed bottom end and an open top end, said outer rim section having a first upper end edge that faces away from said bottom wall and an inner annular surface that terminates at said first upper end edge, said inner rim section having a second upper end edge that faces away from said bottom wall and an outer annular surface that is joined to said second upper end edge and is concentric with and spaced from said inner annular surface, said inner and outer annular surfaces extending lengthwise relative to said side wall and being inclined at an acute angle and in the same direction relative to the central axis of said container, and said annular surfaces having progressively greater diameters with increasing distance from said bottom end of said locking channel.

* * * * *

UNITED STATES PATENT AND TRADEMARK OFFICE

CERTIFICATE OF CORRECTION

PATENT NO. : 6,250,494 B1
DATED : June 26, 2001
INVENTOR(S) : David W. Diamond

It is certified that error appears in the above-identified patent and that said Letters Patent is hereby corrected as shown below:

Column 8, claim 13,
Line 44, delete the comma after "integral";

Column 10, claim 19,
Line 38, "rims" should be -- rim --;

Column 10, claim 20,
Line 50, insert "said" after -- , with --; and

Column 11, claim 20,
Line 8, "and" (first occurrence) should be -- an --.

Signed and Sealed this

Fourth Day of December, 2001

*Attest:*

Nicholas P. Godici

*Attesting Officer*

NICHOLAS P. GODICI
*Acting Director of the United States Patent and Trademark Office*